US008590542B2

(12) United States Patent
Cooper et al.

(10) Patent No.: US 8,590,542 B2
(45) Date of Patent: Nov. 26, 2013

(54) SMOKING ARTICLE WITH THERMORESILIENT DESIGN AND METHODS OF PRODUCING THE SAME

(75) Inventors: Wendy Cooper, London (GB); Kevin Gerard McAdam, London (GB)

(73) Assignee: British American Tobacco (Investments) Limited, London (GB)

( * ) Notice: Subject to any disclaimer, the term of this patent is extended or adjusted under 35 U.S.C. 154(b) by 913 days.

(21) Appl. No.: 12/532,965

(22) PCT Filed: Mar. 7, 2008

(86) PCT No.: PCT/EP2008/052762

§ 371 (c)(1), (2), (4) Date: Mar. 26, 2010

(87) PCT Pub. No.: WO2008/116739

PCT Pub. Date: Oct. 2, 2008

(65) Prior Publication Data

US 2010/0180903 A1 Jul. 22, 2010

(30) Foreign Application Priority Data

Mar. 27, 2007 (GB) ..... 0705887.8

(51) Int. Cl.
*A24D 1/02* (2006.01)

(52) U.S. Cl.
USPC ..... 131/365

(58) Field of Classification Search
None
See application file for complete search history.

(56) References Cited

U.S. PATENT DOCUMENTS

| | | | | |
|---|---|---|---|---|
| 4,721,838 | A | 1/1988 | Abdukarimov et al. | |
| 4,854,332 | A * | 8/1989 | Hanakura | 131/365 |
| 4,911,184 | A * | 3/1990 | Case et al. | 131/365 |
| 5,284,166 | A | 2/1994 | Cartwright et al. | |
| 2002/0034475 | A1 | 3/2002 | Ribi | |
| 2004/0134631 | A1 | 7/2004 | Banerjee et al. | |
| 2005/0005947 | A1 | 1/2005 | Gu et al. | |

FOREIGN PATENT DOCUMENTS

| | | | |
|---|---|---|---|
| DE | 29922719 | U1 | 3/2000 |
| DE | 10020303 | A1 | 3/2002 |
| EP | 0409566 | A1 | 1/1991 |
| FR | 2763080 | A1 | 11/1998 |
| JP | 2092262 | | 4/1990 |
| WO | WO 99/44447 | | 9/1999 |

OTHER PUBLICATIONS

PCT International Search Report and Written Opinion, Jun. 6, 2008.
International Preliminary Report on Patentability, May 20, 2009.

* cited by examiner

*Primary Examiner* — Michael J Felton
(74) *Attorney, Agent, or Firm* — NW Poulsen

(57) ABSTRACT

A smoking article can comprise a rod of smoking material enclosed in a wrapper wherein the wrapper is provided with a design which comprises thermoresilient material.

15 Claims, 2 Drawing Sheets

SMOKING ARTICLE WITH THERMORESILIENT DESIGN AND METHODS OF PRODUCING THE SAME

CLAIM FOR PRIORITY

This application is a National Stage Entry entitled to and hereby claims priority under 35 U.S.C. §§365 and 371 corresponding to PCT Application No. PCT/EP2008/052762, titled, "Smoking article with thermoresilient design and methods of producing the same," filed Mar. 7, 2008, which in turn claims priority to British Application Serial No. GB 0705887.8 filed Mar. 27, 2007, all of which are hereby incorporated by reference.

FIELD OF THE INVENTION

The invention relates to smoking articles, including but not limited to cigarettes, and in particular to smoking articles having designs provided thereon or therein.

BACKGROUND OF THE INVENTION

One basic form for a smoking article is a rod of smokable material enclosed in a combustible wrapper. Examples include cigarettes, cigarillos, and cigars, among others. The rod is preferably of uniform cross-sectional shape and dimensions throughout the length of the rod to facilitate commercial production.

Many smoking articles, particularly those which are preformed and provided to a consumer ready-to-use, incorporate a cylindrical filter element aligned in an end-to-end relationship with the rod of smokable material. Conventional materials for filter elements include fibrous cellulose acetate, polypropylene, polyethylene, and gathered paper material. Multiple filter elements may be utilised. The pressure drop and/or mechanical filtration efficiency of the filter or filter sections can be selected to achieve the desired smoking mechanics and filtration characteristics as may be required with the specific product design desired.

Filters are typically wrapped in plug wrap, and wrapped filters are joined to tobacco rods often through the application of tipping paper. The filter, plug wrap, and/or tipping paper may be provided with holes, preferably holes which extend through at least the tipping paper and plug wrap to provide ventilation. The size, placement, and amount of ventilation holes as well as how they can be formed are known in the art.

The wrapper enclosing the smoking article typically comprises at least a fibrous element; conventional wrappers are papers. The wrapper may have a basis weight in the range of 14-50 g/m$^2$. The wrapper may comprise additives such as burn additives and ash improvers. Examples include sodium citrate, potassium citrate, sodium salts, potassium salts, mono-ammonium phosphate, di-sodium hydrogen phosphate, disodium hydrogen orthophosphate, sodium carbonate, diammonium phosphate.

The wrapper may comprise fillers, such as calcium carbonate, mica, perlite, clays, alumina, magnesium oxide, and titanium oxide or further additives such as starch, alginate, and methylcellulose.

The wrapper may be partially or entirely non-paper, such as the wrappers described in International Patent Applications, Publications Nos. WO 96/07336 and WO 01/41590. Such wrappers assist in the reduction of sidestream smoke components, but still provide a smoking article which has similar burning and ashing characteristics to conventional products.

The smokable material may be any combustible material which provides smoke, such as cut tobacco or other smokable filler material.

Where inorganic filler material is used it might be one or more of perlite, alumina, diatomaceous earth, calcium carbonate, vermiculite, magnesium oxide, magnesium sulphate, zinc oxide, calcium sulphate, pumice, titanium dioxide, calcium aluminate or other insoluble aluminates, or other inorganic filler materials. The density range of the materials might be in the range of 0.1-5.7 g/cm$^3$. An inorganic filler material having a low density, for example less than 3 g/cm$^3$, may improve ash characteristics of the product by reducing the density of the product.

The smokable material may comprise an aerosol generating means which could include polyhydric alcohols, such as glycerol, propylene glycol and triethylene glycol; esters, such as triethyl citrate or triacetin, high boiling point hydrocarbons, or non-polyols, such as glycols, sorbitol or lactic acid. Furthermore, binders may be used, which can include alginic binders such as ammonium alginate, sodium alginate, sodium calcium alginate, calcium ammonium alginate, potassium alginate, magnesium alginate, triethanol-amine alginate and propylene glycol alginate as well as organic binders such as cellulose, sodium carboxymethylcellulose, methyl cellulose, hydroxypropyl cellulose, hydroxyethyl cellulose ethers, gum arabic, gum ghatti, gum tragacanth, Karaya, locust bean, acacia, guar, quince seed, xanthan gums, agar, agarose, carrageenans, furoidan, furcellaran, and starch.

The smoking article may comprise one or more flavouring agents such as tobacco extract flavours, menthol, vanillin or cocoa.

There are a number of ways to improve the appearance of smoking articles or distinguish one type or source of smoking articles from another. For example, cigar appearance can be improved where artificial tobacco sheets are used as cigar wrappers by embossing or printing a leaf pattern on the wrapper so that they more closely resemble natural tobacco. An example of distinguishing types of smoking articles is to provide an indicator on individual smoking articles, such as printing the name or trademark of the article on the wrapping.

Despite these methods, there remains a need in the art for novel, innovative ways to improve the appearance of smoking articles or distinguish smoking articles.

SUMMARY OF THE INVENTION

According to the present invention there is provided a smoking article comprising a rod of smoking material enclosed in a wrapper, where the wrapper is provided with a design which comprises thermoresilient material. By providing thermoresilient material, the design survives combustion and consumption of the smoking material and remains visible in intact portions of wrapper ash thereby providing an improved appearance or an ability to distinguish a type or source of goods.

According to one embodiment, the invention can be embodied in a smoking article comprising a rod of smoking material enclosed in a wrapper, wherein the wrapper is provided with a design which comprises thermoresilient material. The design can comprise at least one logo or portion thereof or at least one letter or portion thereof. The thermoresilient material can comprise an oxide of iron. The wrapper can have a dry weight of for example 20-35 g/m$^2$ or 22-35 g/m$^2$ and can comprise chalk, for example, 20-35% or 22-35% chalk. The wrapper can comprise 0.6-2% potassium citrate. The wrapper of the smoking article has an outer portion facing away from the rod of smoking material and an inner portion facing toward the rod of smoking material; the design can be provided on the outer and/or the inner portion of the wrapper.

According to another embodiment, the invention provides a method of producing a smoking article comprising enclosing a rod of smokable material in a wrapper and providing the wrapper with a design at least one of before or after the enclosing step wherein the providing step comprises providing thermoresilient material to the wrapper. The providing step could comprise applying a suspension, solution, or paste of thermoresilient material to the wrapper and could comprise printing or spraying. The method could further comprise drying the wrapper after the providing step.

As used herein "smoking material" refers to any material which can be used in a smoking article. It does not necessarily mean that the material itself will sustain combustion. The smoking material may be particulate in nature or may be pieces broken or cut from a sheet. The smoking material may be a blend of a plurality of components including fillers, binders, flavourants, and the like.

"Design" means any pattern and includes, among others, lettering, numbers, symbols, randomly and non-randomly placed marks. A design could be a stand alone image on a single smoking article or a design provided as a series of design components on a plurality of articles.

"Thermoresilient material" refers to any material which maintains attributes of its appearance after a base material comprising the thermoresilient material combusts or goes through a physical change due to proximity to a heat source. The term includes but is not limited to thermochromic materials which present a first appearance prior to exposure to temperature change and a second appearance following exposure temperature change. Thermochromic materials may have a permanent or reversible colour change upon or following exposure to a temperature change.

BRIEF DESCRIPTION OF THE DRAWING FIGURES

In order that the subject invention may be easily understood and readily carried into effect, reference will now be made, by way of example, to the accompanying figures, in which.

DETAILED DESCRIPTION

Figure 1:
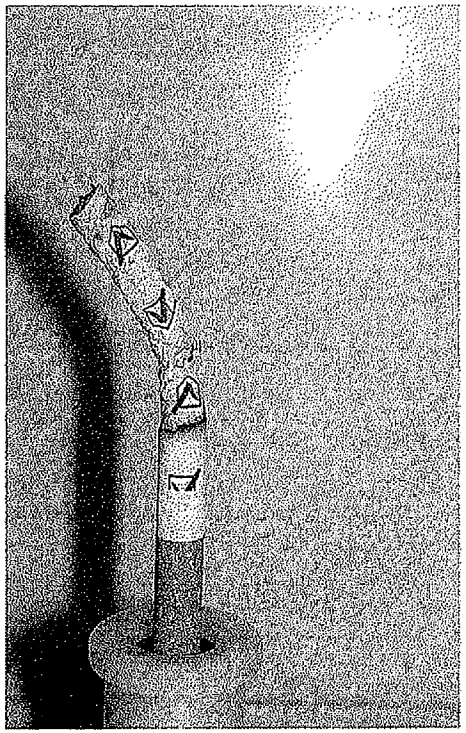
FIG. 1 shows a photograph of a smoking article which has been printed with black ink and allowed to smoulder.

There are instances in which it is desirable to provide a design on smoking articles. For example, consumers may benefit from an improved appearance of the smoking article, which improvement might be for informative purposes or purely for entertainment. For example, some existing smoking articles incorporate the product name or trademark on the article's wrapper to inform the consumer as to source. Another example of a potential use of design on article wrappers would be to provide a design which corresponds to a flavourant in the smoking material, such as a mint leaf design on wrappers for menthylated smoking articles.

Producers of smoking articles may also find it desirable to provide a distinguishing design on the article for purposes such as quality control. One way to do this would be to incorporate a design, such as letters and numbers corresponding to location and date of production, on the wrapping paper for the article. As this might preferably not be on a surface of the article which is visible to users, one option is to print the design on the side of the wrapper which is intended to face the smoking material after assembly. The drawback of placing a design in this location is that inspection of the design requires careful disassembly of the unadulterated article.

Thus a design comprising thermoresilient material offers a novel way to modify the appearance of smoking articles with a benefit to both consumers and producers.

Thermoresilient Materials

Thermoresilient materials which might be used to practice the invention include thermochromic materials, such as those employed in the fields of foods and pharmaceuticals and which often are used to indicate when a food is "done" or when a pharmaceutical is no longer suitable for use. See, for example, US 2002 0034475.

Other thermoresilient materials are those which may or may not undergo a colour change in response to a change in temperature, but nonetheless maintain their ability to be seen after heating or combustion. One example is the class of ferric (iron) oxides, which are generally available in red, yellow, and black forms and which appear as the red form after a substrate material on which they are applied or incorporated is heated or combusted.

Attempts to provide solid-coloured wrapping paper have even included trials with iron oxide in the paper furnish. See U.S. Pat. No. 5,284,166. These trials all note that, even when present in small amounts, the iron oxide presents a problem in that the ash remaining after combustion is noticeably red.

It is also known to incorporate ultrafine particles of iron oxide in discrete regions of wrapping paper to reduce ignition propensity, see US 2004 0134631, and it is known to incorporate iron oxide particles in wrapping paper as a carbon monoxide reducing agent, see US 2005 0005947. In these applications, though, iron oxides negatively affect the desired white colour of the wrapping paper so it is taught to provide them on the inside of the wrapping paper.

One use of iron oxides which does not raise the problem of discolouration of the wrapping is the use of red and yellow iron oxides in tipping paper, for example, to create a traditional cork-like appearance. This is done by incorporating yellow iron oxide as an additive in the tipping paper and/or by printing yellow and red iron oxides on tipping paper. Tipping paper encloses the filter segment and barely extends onto the base of the rod of smoking material so it is not combusted during use, thus the problem with red ash does not occur.

The composition of the thermoresilient material applied to the wrapper can vary. Generally, the composition is determined by the thermoresilient ingredients. Preferably, the coating formulation has an overall composition, and is applied in a manner and in an amount such that the physical integrity of the wrapping material is not adversely affected when one ore more applications of the formulation are provided to the wrapper to create a design. It is preferred that no components of the coating formulation introduce undesirable sensory characteristics to the smoke generated by a smoking article comprising the design. Thus, suitable combinations of various components can act to reduce the effect of thermoresilient material on sensory characteristics of smoke generated by the smoking article during use.

The coating formulation may optionally include a film-forming agent. The film-forming agent could be a polymeric material or resin. Exemplary film-forming agents include alginates, pectins, derivatives of cellulose, ethylene vinyl acetate copolymers, guar gum, xanthan gum, starch, modified starch, polyvinyl acetate and polyvinyl alcohol.

The thermoresilient material may be provided as a formulation for application, which formulation will dry or otherwise cure after application to the wrapper. Multiple solvents or liquid carriers could be employed. For example, the solvent can be a liquid having an aqueous character, such as water. The solvent could alternatively be a non-aqueous solvent. Mixtures of organic solvents could be employed. Mixtures of organic and aqueous liquids are also contemplated. Ideally solvents do not adversely affect the wrapper by, e.g., causing swelling of the fibres, causing puckering, or causing wrinkling. Hydrophobic non-aqueous solvents typically have less of a tendency to adversely affect the physical nature of the wrapper than do aqueous solvents; however, for design s incorporating small amounts of thermoresilient material and therefore comparatively small amounts of solvent or carrier, they may not necessarily have an effect on the wrapper. Application techniques may also be optimised to avoid impact, such as maintaining the wrapper taut while applying and allowing the material to dry.

Preferably, where a solvent or carrier is used the thermoresilient material is readily dissolvable or at least dispersible in that solvent or carrier. Suitable solvents or carriers include water, alcohols, and esters. Additives may be used to maintain dispersibility, alternative measures like stirring or temperature adjustment may also be used. While certain aspects of the formulation depend on the ingredients, they can be controlled to form, e.g., emulsions, suspensions, or liquids. Viscosity and other physical properties of the formulation can be tailored to the printing technique used.

Wrapper

The wrapping material that is provided with thermoresilient material according to the present invention can have a wide range of compositions and properties. The selection of a particular wrapping material will be readily apparent to those skilled in the art of smoking article design and manufacture. The present invention can rely on standard production techniques and processing equipment used to manufacture those wrapping materials.

Preferred embodiments of the invention will take into account the ability to view the design after heating or combustion and will thus consider the ashing qualities of the wrapper. For example, a large design or one in which it will be useful to keep letters and/or numbers in a particular configuration might best be suited to a wrapper which ashes in large, cohesive flakes, whereas a smaller or repeating design could be provided on a wrapper which provides smaller flakes.

Typical wrapping material base sheets suitable for use as the circumscribing wrappers of tobacco rods for cigarettes have basis weights that can vary. Typical dry basis weights of base sheets are at least about 15 g/m$^2$, and frequently are at least about 20 g/m$^2$; while typical dry basis weights do not exceed about 80 g/m$^2$, and frequently do not exceed about 60 g/m$^2$. Many preferred wrapping material base sheets have basis weights of less than 50 g/m$^2$, and even less than 40 g/m$^2$. Certain paper wrapping material base sheets preferred in the industry have basis weights between about 20 g/m$^2$ and about 40 g/m$^2$ such as, for example, 20-35 g/m$^2$ or 22-26 g/m$^2$.

Some advantages may be present where the material used to form the wrapper is manipulated to produce a particular ashing pattern. For example, certain designs might best be viewed where there are large portions of pale coloured ash remaining after combustion. Ways to provide paper which ashes in large flakes are known to skilled persons. Alternatively or in addition, incorporating one or a plurality of patches or strips on the side of the wrapper facing the smoking material may cause overlying regions of wrapper to have increased structural integrity even after heating or combustion. A dual or multi-layered wrapper or one which is coated before or after addition of the design may also provide this benefit.

Typical wrapping material base sheets suitable for use as wrappers for smoking articles have inherent porosities that can vary. Typical base sheets have porosities that are at least about 5 CORESTA units, usually are at least about 10 CORESTA units, often are at least about 15 CORESTA units, and frequently are at least about 20 CORESTA units. Typical base sheets have inherent porosities that are less than about 200 CORESTA units, usually are less than about 150 CORESTA units, often are less than about 85 CORESTA units, and frequently are less than about 70 CORESTA units. A CORESTA unit is a measure of the linear air velocity that passes through a 1 cm2 area of wrapping material at a constant pressure of 1 centibar.

Where a paper wrapper is employed, it may incorporate at least one type of fibrous material and/or at least one type of filler material, in amounts that can vary. Base sheets are known which include about 55 to about 100, often about 65 to about 95, and frequently about 70 to about 80 percent fibrous material (which may be a cellulosic material); and about 0 to about 45, often about 5 to about 35, and frequently about 20 to about 30 percent filler material (which may be an inorganic material); based on the dry weight of that base sheet.

The fibrous material can be a cellulosic material, such as lignocellulosic material. Examples include flax fibres, hardwood pulp, softwood pulp, hemp fibres, esparto fibres, kenaf fibres, jute fibres and sisal fibres. Mixtures of two or more types can be employed. Other fibrous materials that can be incorporated within wrapping materials include microfibres materials and fibrous synthetic cellulosic materials. The fibres are normally bleached but can be unbleached.

The filler material can have the form of essentially water insoluble particles. Normal filler materials incorporate inorganic components. Examples include calcium carbonate in particulate form or agglomerated calcium carbonate particles, calcium tartrate particles, magnesium oxide particles, magnesium hydroxide gels; magnesium carbonate-type materials, clays, diatomaceous earth materials, titanium dioxide particles, gamma alumina materials and calcium sulfate particles. Certain filler materials can be fibrous.

There are various ways by which the various additive components can be added to, or otherwise incorporated into, the base sheet. Certain additives can be incorporated into the wrapping material as part of the paper manufacturing process associated with the production of that wrapping material. Alternatively, additives can be incorporated into the wrapping material using size press techniques, spraying techniques, printing techniques, or the like. Various additives can be added to, or otherwise incorporated into, the wrapping material simultaneously or at different stages during or after the paper manufacturing process. These techniques are known to the skilled person.

The base sheets can be further treated to impart a change in the overall physical characteristics or chemical compositions thereof. For example, the base sheet can be perforated or embossed. Additives such as alkali metal salts, for example, alkali metal succinates, citrates, acetates, malates, carbonates, chlorides, tartrates, propionates, nitrates and glycolates; including sodium succinate, potassium succinate, sodium citrate, potassium citrate, sodium acetate, potassium acetate, sodium malate, potassium malate, sodium carbonate, potassium carbonate, sodium chloride, potassium chloride, sodium tartrate, potassium tartrate, sodium propionate, potassium propionate, sodium nitrate, potassium nitrate, sodium glycolate and potassium glycolate; and other salts such as monoammonium phosphate could be added. Certain of these components, such as metal citrates, can act as ash conditioners or ash sealers.

Typical paper wrappers that can be used in carrying out the present invention are preferably manufactured under specifications directed toward the production of a wrapping material having an overall generally consistent composition and physical parameters. For those types of wrapping materials, the composition and parameters thereof preferably are consistent when considered over regions of each of the major surfaces of those materials. However, typical wrapping materials tend to have a "two-sided" nature, and thus, there can be changes in the composition and certain physical parameters of those materials from one major surface to the other. Where wrappers are provided which have variation over their surfaces it may be necessary to adjust the step of providing thermoresilient material to the wrapper such that alignment and registration of the design is taken into account.

Providing Thermoresilient Material to the Wrapper

The invention relates to any method or means for incorporating thermoresilient materials in wrappers. As wrappers may be single or multi-layered, and may or may not be coated or provided with an outer or inner (i.e., opposite or adjacent to the smoking material once the smoking article is formed) patch or film, a plurality of design options are available. The design may be incorporated during the formation of the wrapper, such as sprayed onto the furnish while drying. The design may instead be added to the wrapper after its preparation is complete but before it is provided to equipment used to wrap smoking material. Furthermore, the design could be added to the wrapper during wrapping of the smoking material or after the smoking article is complete. The time and means of application will accommodate different types of thermoresilient material as should be evident to a skilled person.

Depending on the material used and the application technique employed, application of one layer of thermoresilient material may be sufficient, in other instances several layers of the appropriate formulation may be applied to a wrapping material. A printing process may be preferred where the thermoresilient material is provided in suspension or solution. The coating formulation may be applied using intaglio processes and gravure coating techniques, such as rotogravure printing techniques, may be used.

Gravure printing techniques involve printing from the continuous surface of a metal cylinder engraved mechanically or etched chemically so as to possess minute grooves or cells below the surface of that cylinder. A typical printing cylinder surface is provided by etching a smooth, polished copper surface and plating that etched surface with chrome. Those recessed cells or grooves hold liquid (or liquid dispersion) formulations form impressions, layers or bumps to be deposited onto the desired location of a substrate, such as a continuous web of wrapper. Rotogravure printing presses are commercially available.

Other techniques for applying thermoresilient material to the wrapper include blade coating, air-knife coating, roll-coating and shaft coating techniques. Alternatively and/or additionally, the thermoresilient material can be applied by spraying, ink jet coating, or other techniques.

The design may be applied to the wrapping material offline, that is, offline relative to the manufacture of the wrapping material. Alternatively, it may be incorporated into the wrapper manufacture process. Another option which may be used where the thermoresilient material is provided to the outside of the smoking article is to apply the thermoresilient material to the wrapper after the smoking article is formed. A drying step may be required, in particular when thermoresilient material is employed in liquid form. Where application is made to a formed smoking article the application and optional drying drying should be done in such a way so as to not affect the rod of smoking material or any filter provided therewith.

Example 1

A powdered yellow iron oxide is added to ethyl acetate to create a high-viscosity suspension. Online, subsequent to paper manufacture but prior to cigarette making, the suspension is applied with ink jet printing techniques to form a random-looking pattern of solid yellow stars on conventional cigarette wrapping paper. The ink is allowed to dry before the paper is used in cigarette making.

On a conventional cigarette making machine, the printed paper is used to wrap cigarettes so that the star design faces outward on the finished article. Because the design is random-looking, there is no need to line up any particular portion of the design with the tobacco rod to affect a certain appearance in the finished product.

Wrapped cigarettes are lit and smoked by a user. The ash formed at the burned end of the cigarette carries the same star pattern, however, the stars are red in the ash portion while remaining yellow in the still-unburned portion of the cigarette.

Example 2

Preparation of a Cigarette Comprising a Thermoresilient Design

A black iron oxide powder is moistened to form a paste according to conventional tipping paper printing techniques. Cigarettes are manufactured according to known techniques, using a conventional white wrapping paper having a base weight of 25 g/m$^2$ and an ash conditioner. After cigarette formation but prior to packaging the cigarettes the black iron oxide paste is applied to the wrapping paper on the outside of the tobacco rod through screen printing of a symbol in a repetitious pattern along the paper.

As desired, the cigarettes could be packed. When smouldered, the design comprising black symbols appears red in the ash, see FIG. 1.

Example 3

Comparative Tests of Smoking Articles Comprising Thermoresilient Designs

Figure 2:
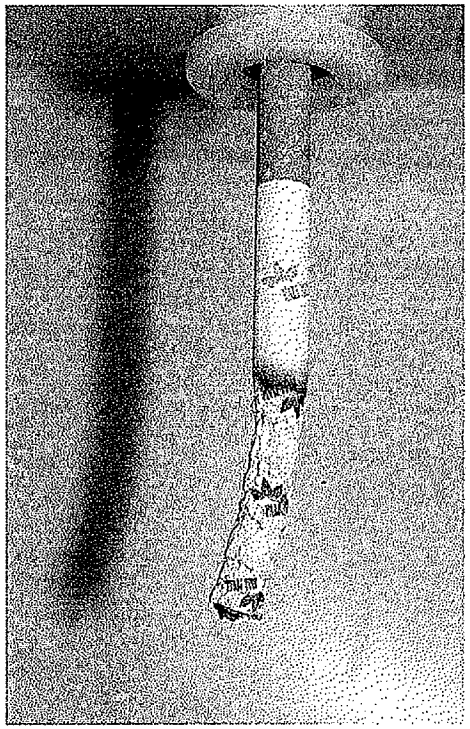
FIG. 2 shows a photograph of a smoking article which has been printed with yellow ink and allowed to smoulder.
Figure 3:
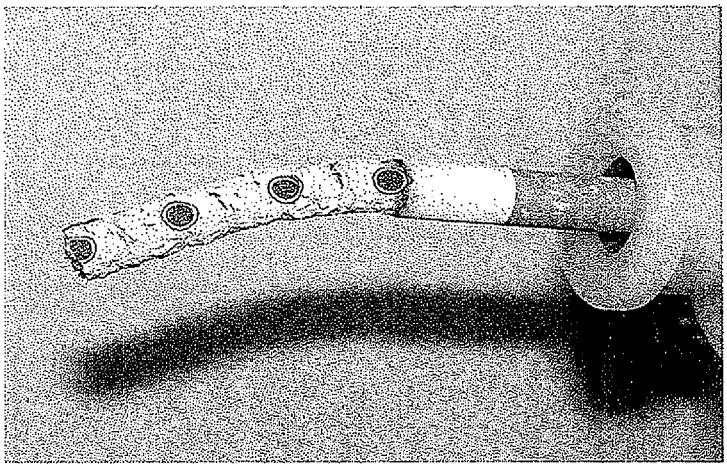
FIG. 3 shows a photograph of a smoking article which has been printed with red ink and allowed to smoulder.
Figure 4:
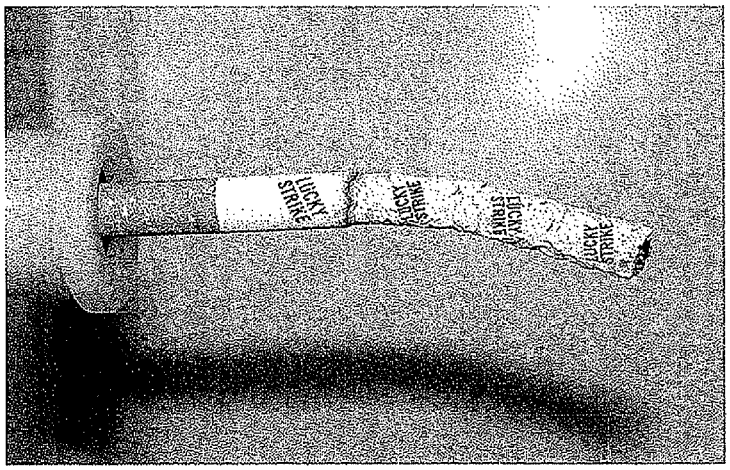
FIG. 4 shows a photograph of another smoking article which has been printed with red ink and allowed to smoulder.

Cigarettes were prepared according to Example 2, but using different coloured inks and different designs. Cigarettes were placed in a smoking machine and allowed to smoulder. FIG. 2 shows how a cigarette comprising wrapping paper printed with a yellow ink design having lettering and a visual element smoulders. The lettering and visual element are visible as red printing in the ash. FIGS. 3 and 4 show how a cigarette comprising a red ink design or lettering, respectively, smoulders to reveal a consistent red design or lettering in the ash.

As is evident in the figures, all the machine smoked cigarettes retain the thermoresilient design after smoking. The figures also show how coherent a smouldered ash from a paper having ash conditioner is. While cigarettes are typically are allowed to smoulder at times, they are generally intermittently puffed creating a more flaky ash which disrupts the design elements. This disruption is less prominent when ash conditioner is present. While some embodiments most expediently incorporate an ash conditioner in the wrapping paper, it is known in the art, particularly with regard to tobacco substitutes, how to achieve preferred ashing qualities through different tobacco or tobacco blend additives or treatment processes, all of which are within the scope of this invention.

Example 4

Preparation of a Smoking Article Comprising a Thermoresilient Design

A powdered red iron oxide is mixed into a suspension. Online, subsequent to paper manufacture but prior to cigarette making, the suspension is applied with ink jet printing techniques. The printed design consists of a series of letters and numbers printed across the width of the paper save the edges, which will overlap when sealed in a cylindrical shape. The design is repeated along the length of the paper with unprinted regions in between the printed regions. The ink is allowed to dry before the paper is used in cigarette making.

On a conventional cigarette making machine, the printed paper is used to wrap cigarettes so that the printed design faces inward toward the tobacco rod in the finished article. The paper is fed into the machine such that the unprinted regions of the paper are present in the middle and at the tip of the cigarette while the printed region is located near the filter end of the cigarette. The cigarettes are packed, distributed and sold as desired.

According to this example, the letters and numbers of the design are dictated by the time and location of production. When used on a smoking article such as a cigarette, they are an indication of source and age of the articles. Research can be conducted on smoked articles to determine which of them contain the printed design. Of those, it can be determined where and when the articles were produced. This can be done to ensure fresh goods were consumed.

It can also be done to ascertain where articles smoked in a region were produced. Furthermore, articles bearing certain hallmarks of a particular producer, for example, a trademark, can be analyzed either prior to consumption or via an analysis of the ash in consumed products, to see whether those articles were printed with the appropriate marking as an indicator of the authenticity of the articles.

The foregoing description and examples have been set forth merely to illustrate the invention and are not intended to be limiting. All references cited herein are expressly incorporated by reference. Since modifications of the described embodiments incorporating the spirit and substance of the invention may occur to persons skilled in the art, the invention should be construed broadly to include all variations within the scope of the appended claims and equivalents thereof.

The invention claimed is:

1. A smoking article, comprising:
a wrapper,
a rod of smoking material enclosed in the wrapper, and
a thermoresilient material applied to the wrapper,
wherein the thermoresilient material applied to the wrapper comprises a post-combustion visible design;
wherein the wrapper has an inner portion facing toward the rod of smoking material, and
wherein the thermoresilient material is applied on the inner portion of the wrapper.

2. The smoking article according to claim 1,
wherein the thermoresilient material comprises an oxide of iron.

3. The smoking article according to claim 1,
wherein the wrapper has a dry weight of 22-35 g/m$^2$ and
wherein the wrapper comprises chalk.

4. The smoking article according to claim 3,
wherein the wrapper comprises 22-35% chalk.

5. The smoking article according to claim 3,
wherein the wrapper comprises 0.6-2% potassium citrate.

6. The smoking article according to claim 1,
wherein the post-combustion visible design comprises at least one logo or portion thereof.

7. A method of producing a smoking article, comprising:
enclosing a rod of smokable material in a wrapper, and
applying a thermoresilient design to an inner rod-facing portion of the wrapper before enclosing the rod of smokable material in the wrapper such that the design is visible after a portion of the wrapper on which it is applied has been burned.

8. The method according to claim 7,
wherein applying the thermoresilient design comprises one of printing and spraying thermoresilient material on the wrapper.

9. The method according to claim 7,
further comprising drying the wrapper after applying the thermoresilient design to the wrapper.

10. The method according to claim 7,
wherein applying the thermoresilient design comprises applying one of a suspension, solution and paste of thermoresilient material to the wrapper.

11. A method of producing a smoking article, comprising:
enclosing a rod of smokable material in a wrapper, and
applying a thermoresilient design to an inner rod-facing portion of the wrapper after enclosing the rod of smokable material in the wrapper such that the design is visible after a portion of the wrapper on which the design is applied has been burned.

12. The method according to claim 11,
wherein applying the thermoresilient design to the wrapper comprises one of printing and spraying thermoresilient material on the wrapper.

13. The method according to claim 11,
further comprising drying the wrapper after applying the thermoresilient design to the wrapper.

14. The method according to claim 11,
wherein applying the thermoresilient design to the wrapper comprises applying one of a suspension, solution or and paste of thermoresilient material to the wrapper.

15. The smoking article according to claim 1,
wherein the design comprises at least one letter or portion thereof.

* * * * *

UNITED STATES PATENT AND TRADEMARK OFFICE

CERTIFICATE OF CORRECTION

PATENT NO. : 8,590,542 B2
APPLICATION NO. : 12/532965
DATED : November 26, 2013
INVENTOR(S) : Cooper et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1094 days.

Signed and Sealed this
Third Day of March, 2015

Michelle K. Lee

Michelle K. Lee
*Deputy Director of the United States Patent and Trademark Office*